US011692703B2

(12) United States Patent
Brückner et al.

(10) Patent No.: US 11,692,703 B2
(45) Date of Patent: Jul. 4, 2023

(54) WATER FEEDBACK IN VERTICAL FORCED-FLOW STEAM GENERATORS

(71) Applicant: Siemens Energy Global GmbH & Co. KG, Munich (DE)

(72) Inventors: Jan Brückner, Uttenreuth (DE); Martin Effert, Erlangen (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 634 days.

(21) Appl. No.: 16/492,140

(22) PCT Filed: Mar. 13, 2018

(86) PCT No.: PCT/EP2018/056199

§ 371 (c)(1),
(2) Date: Sep. 8, 2019

(87) PCT Pub. No.: WO2018/177738

PCT Pub. Date: Oct. 4, 2018

(65) Prior Publication Data

US 2021/0131312 A1 May 6, 2021

(30) Foreign Application Priority Data

Mar. 30, 2017 (DE) ..... 10 2017 205 382.8

(51) Int. Cl.
*F22B 29/12* (2006.01)
*F01K 13/02* (2006.01)
(Continued)

(52) U.S. Cl.
CPC ..... *F22B 29/12* (2013.01); *F01K 13/02* (2013.01); *F22B 29/06* (2013.01); *F22B 29/062* (2013.01);
(Continued)

(58) Field of Classification Search
CPC ..... F22B 29/12; F22B 29/06; F22B 29/062; F22B 35/007; F22B 35/10; F22B 35/102;
(Continued)

(56) References Cited

U.S. PATENT DOCUMENTS 3,532,453 A 10/1970 Zipay
4,129,140 A * 12/1978 Carlin ..... F24F 6/04 417/40
(Continued)

FOREIGN PATENT DOCUMENTS

CN 103459926 A 12/2013
DE 3236979 A1 4/1984
(Continued)

OTHER PUBLICATIONS

English Translation of JP-2007315726-A, dated Mar. 15, 2022 (Year: 2022).*
(Continued)

*Primary Examiner* — Edelmira Bosques
*Assistant Examiner* — Brett Peterson Mallon

(57) ABSTRACT

A method for starting a vertical forced-flow steam generator in a waste-heat steam generator, wherein feed water is fed to the forced-flow steam generator as working fluid, and there flows firstly through a feed-water preheater and then through an evaporator and is at least partly evaporated, wherein the partly evaporated working fluid is fed to a water separation system, in which non-evaporated working fluid is separated from evaporated working fluid and is collected, in which at least part of the non-evaporated working fluid is fed geodetically to the evaporator and, beginning from a certain quantity of accumulating non-evaporated working fluid, a remaining part is automatically removed from the water
(Continued)

separation system. A corresponding device is for starting a vertical forced-flow steam generator according to the method.

5 Claims, 5 Drawing Sheets

(51) Int. Cl.

| | |
|---|---|
| ***F22B 29/06*** | (2006.01) |
| ***F22B 35/00*** | (2006.01) |
| ***F22B 35/10*** | (2006.01) |
| ***F22B 35/14*** | (2006.01) |
| ***F22B 37/26*** | (2006.01) |
| ***F22D 1/00*** | (2006.01) |

(52) U.S. Cl.
CPC ..... *F22B 35/007* (2013.01); *F22B 35/10* (2013.01); *F22B 35/102* (2013.01); *F22B 35/14* (2013.01); *F22B 37/26* (2013.01); *F22D 1/003* (2013.01)

(58) Field of Classification Search
CPC ..... F22B 35/14; F22B 37/26; F22B 37/266; F22B 37/72; F22B 37/263; F22B 37/30; F22B 37/32; F01K 13/02; F22D 1/003; F22D 7/04; F04F 10/00; F23M 9/10
USPC ..... 122/34, 414, 188
See application file for complete search history.

(56) References Cited

U.S. PATENT DOCUMENTS

| | | | | |
|---|---|---|---|---|
| 4,520,762 | A | 6/1985 | Martin | |
| 5,588,400 | A | 12/1996 | Stefan et al. | |
| 5,839,396 | A * | 11/1998 | Franke | F22B 35/14 122/406.5 |
| 6,173,679 | B1 * | 1/2001 | Bruckner | F22B 1/1815 122/451 S |
| 2014/0014189 | A1 | 1/2014 | Brodesser et al. | |

FOREIGN PATENT DOCUMENTS

| | | | |
|---|---|---|---|
| DE | 4303613 | A1 | 8/1994 |
| DE | 19702133 | A1 | 12/1997 |
| EP | 0544615 | A1 | 6/1993 |
| EP | 0812407 | A1 | 12/1997 |
| JP | S4818082 | U | 3/1973 |
| JP | S59209628 | A | 11/1984 |
| JP | S59209628 | A * | 11/1984 |
| JP | S61228201 | A | 10/1986 |
| JP | S61228201 | A * | 10/1986 |
| JP | 2007315726 | A | 12/2007 |
| JP | 2007315726 | A * | 12/2007 |
| JP | 2008151503 | A | 7/2008 |
| WO | 9709565 | A2 | 3/1997 |
| WO | 9730312 | A1 | 8/1997 |

OTHER PUBLICATIONS

English Translation of JPS61228201A, dated Mar. 15, 2022 (Year: 2022).*
English Translation of JPS59209628A, dated Mar. 15, 2022 (Year: 2022).*
Weiss, T.: "Das dynamische Verhalten eines Abhitzedampferzeugers mit Zwangsdurchlauf": Dusseldorf: VDI Verlag 2003 (Reihe 6); pp. 10, 12, 15-17; ISBN 3-18-349806; The dynamic behavior of a forced heat recovery steam generator; ENGLISH Machine translation attached.
PCT International Search Report and Written Opinion of International Search Authority dated Jul. 23, 2018 corresponding to PCT International Application No. PCT /E P201 8/056199 filed Mar. 13, 2018.

* cited by examiner

WATER FEEDBACK IN VERTICAL FORCED-FLOW STEAM GENERATORS

CROSS REFERENCE TO RELATED APPLICATIONS

This application is the US National Stage of International Application No. PCT/EP2018/056199 filed Mar. 13, 2018, and claims the benefit thereof. The International Application claims the benefit of German Application No. DE 10 2017 205 382.8 filed Mar. 30, 2017. All of the applications are incorporated by reference herein in their entirety.

FIELD OF INVENTION

The invention relates to a method for starting up a vertical forced-flow steam generator in a waste-heat steam generator, and to a device for starting up a vertical forced-flow steam generator in a waste-heat steam generator.

BACKGROUND OF INVENTION

Waste-heat steam generators with a forced-flow evaporator are known as so-called horizontal BENSON waste-heat steam generators (with a horizontal flue gas path) and vertical BENSON waste-heat steam generators (with a vertical flue gas path). The embodiment with a vertical flue gas path has cost advantages in comparison with the horizontal design. On the other hand, there are operational disadvantages of the vertical BENSON waste-heat steam generator in the form of considerably higher water consumption, caused by a considerably greater expulsion of water (blowdown) during startup.

SUMMARY OF INVENTION

It is therefore an object of the invention to specify a method for starting up a vertical forced-flow steam generator, that is to say with a vertical flue gas path, in a waste-heat steam generator, in which the water consumption is reduced in comparison with the prior art. A further object of the invention is to specify a corresponding device for starting up a vertical forced-flow steam generator in a waste-heat steam generator.

The invention achieves the object directed toward a method for starting up a vertical forced-flow steam generator in a waste-heat steam generator in that it provides that, for such a method for starting up a vertical forced-flow steam generator in a waste-heat steam generator, wherein feed water is supplied as working fluid to the forced-flow steam generator, and there flows firstly through a feed water preheater and then through an evaporator and in the process at least partially evaporates, the partially evaporated working fluid being supplied to a water separation system in which non-evaporated working fluid is separated beyond evaporated working fluid and is collected, at least a portion of the non-evaporated working fluid collected in the water separation system is supplied geodetically to the evaporator and, beyond a specific quantity of accumulating non-evaporated working fluid, a remaining portion is automatically discharged from the water separation system.

Owing to the return of the non-evaporated working fluid, the water consumption of the gas and steam turbine installation is reduced considerably. The systems required for the disposal of the accumulating waste water may be designed to be smaller (and thus at a lower cost). The systems required for the refeeding of the required deionate may likewise be designed to be smaller (and thus at a lower cost).

Owing to the geodetic return, the use of pumps is no longer necessary. This has a positive effect both with the investments and with the fail-safety of the installation.

It is expedient here if the water separation system comprises a separator and a bottle and the non-evaporated working fluid is returned from the separator, since this keeps the outlay for a geodetic return low in comparison with an embodiment without separation of separator and bottle.

It is very particularly advantageous if, for returning the non-evaporated working fluid to the evaporator from the water separation system, merely a shut-off fitting is opened and the quantity of returned working fluid is regulated solely by the geometry of the water separation system.

The object directed toward a device for starting up a vertical forced-flow steam generator in a waste-heat steam generator is achieved by a device with a feed water preheater which, by means of a feed water pump, can be supplied with feed water as working fluid via a feed water supply line, with an evaporator which is arranged downstream of the feed water preheater in the direction of flow of the working fluid and which can be flowed through by the working fluid and can at least partially evaporate said working fluid, with a water separation system at the outlet of the evaporator, which is able to separate non-evaporated working fluid from evaporated working fluid, wherein the water separation system comprises a separator and a bottle, which are designed as separate containers, wherein a return line from the separator opens into a point of connection of the evaporator and a working-medium outlet for the return line in the separator is situated so far above the point of connection that a geodetic return of the non-evaporated working fluid into the evaporator via the return line is possible, wherein furthermore, a drain line branches off from the separator and opens into the bottle and is arranged in the water separation system such that it is arranged, at least in part, above the return line.

If more water arrives at the separator than can flow back into the evaporator, the fill level in the separator will rise up to a point defined by the arrangement of the drain line and then automatically flow off into the bottle. This water which flows off into the water bottle is discharged in the hitherto known manner.

In one advantageous embodiment, a shut-off fitting is arranged in the return line, with the result that, upon ending of the water expulsion, the return line to the evaporator can be closed.

It is furthermore advantageous for a check valve to be arranged in the return line, with the result that the flow of the non-evaporated working fluid is also possible only in one direction, specifically from the water separation system to the evaporator.

In one advantageous embodiment, the drain line comprises a pipe which projects into the separator through the bottom of the separator.

It is furthermore advantageous for a first evacuation line to be arranged at a lower end of the separator, and to open into the bottle, such that it is possible for the separator to be evacuated as completely as possible.

It may also be advantageous if one part of the drain line between the separator and the bottle is formed in a siphon-like manner and, at its lowest point, is provided with a second evacuation line, which opens into the bottle.

The stated embodiments all have the advantage that return and drainage are realized automatically and result from the geometry of the water separation system, and no active regulation is necessary, such as for example in the case of a solution in which, in the return line, there is arranged a valve arrangement with the function of a three-way valve, from which one line branches off into the bottle.

BRIEF DESCRIPTION OF THE DRAWINGS

The invention will be discussed in more detail by way of example on the basis of the drawings. In the drawings, in each case schematically and not to scale.

DETAILED DESCRIPTION OF INVENTION

Figure 1:
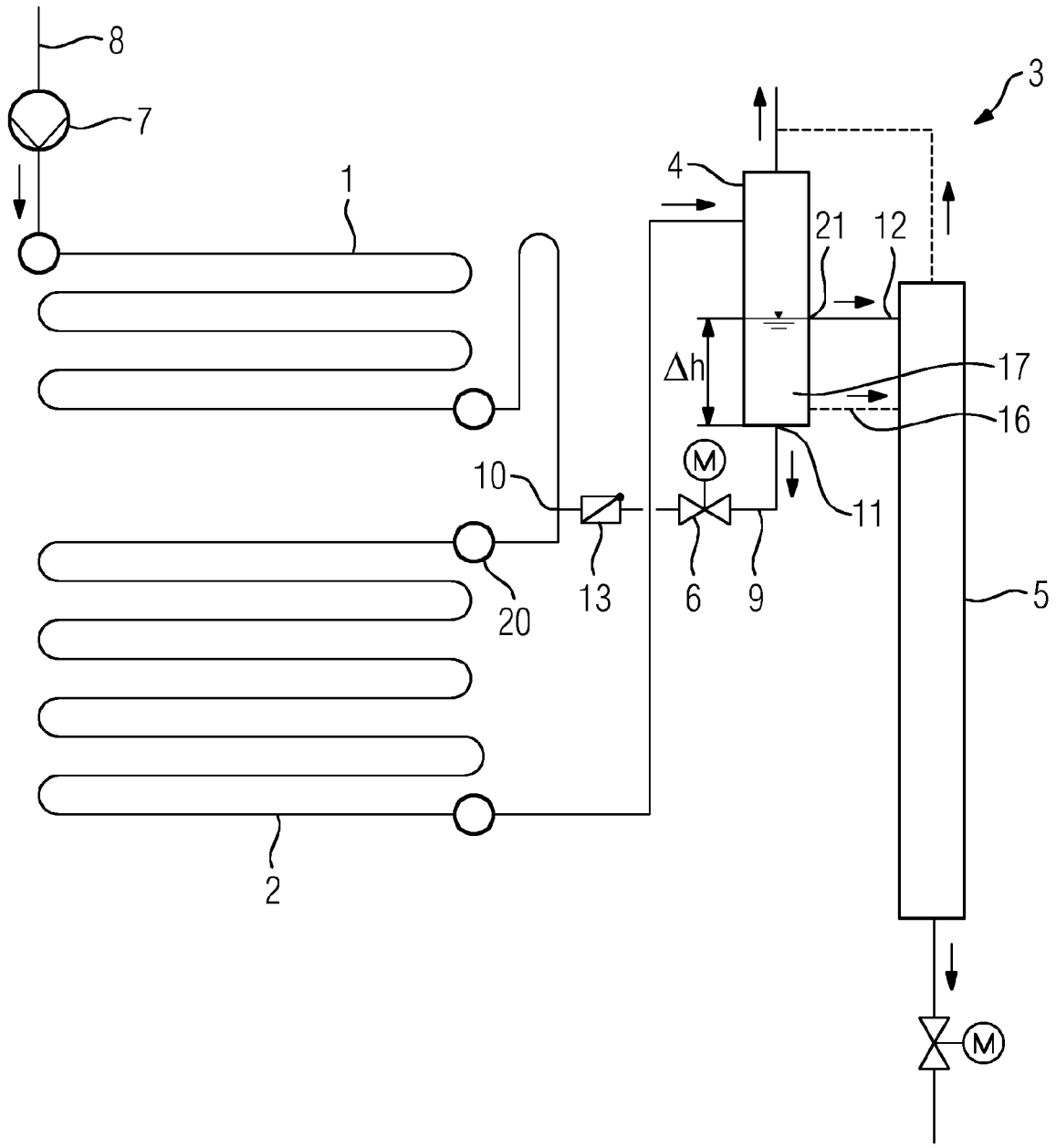
FIG. 1 shows a device for starting up a vertical forced-flow steam generator, with a water separation system in which, according to the invention, a separator and a bottle are separated.

FIG. 1 shows, schematically and by way of example, a device for starting up a vertical forced-flow steam generator, with a feed water preheater 1 which, by means of a feed water pump 7, can be supplied with feed water as working fluid via a feed water supply line 8, and with an evaporator 2, and also with a water separation system 3. For the implementation of the inventive device, it is necessary for the separator 4 to be separated from the water bottle 5 in the water separation system 3. A technically less advantageous solution with a common container for separator and bottle is shown in FIG. 2.

In the embodiment in FIG. 1, the lower end 17 of the separator 4 is situated well above a point of connection 10 into the evaporator 2, for example above the inlet collector 20. In this way, geodetic drainage from the separator 4 to the evaporator 2 is made possible. The drainage is realized from the working-medium outlet 11 up to the point of connection 10 via the return line 9 and the shut-off fitting 6 situated therein. Furthermore, a check valve 13 is arranged in the return line 9 in the exemplary embodiment in FIG. 1.

As soon as, during startup, the water expelled from the evaporator 2 arrives in the separator 4 and is separated out, this water can flow back into the evaporator 2. The efficiency of this measure increases if the evaporator 2 is not completely filled for the startup. If more water arrives at the separator 4 than can flow back into the evaporator 2, the fill level in the separator 4 will rise up to the overflow 21 into the water bottle 5. This water which overflows into the water bottle 5 from the separator 4 via a drain line 12 is discharged in the hitherto known manner. If the water expulsion has ended (pressure rise in the system), the shut-off fitting 6 in the return line 9 to the evaporator 2 is closed. A second first evacuation line 16, of smallest possible design, from the separator 4 to the water bottle 5 serves exclusively to evacuate the separator 4 as completely as possible during operation and while the installation is at a standstill.

Figure 2:
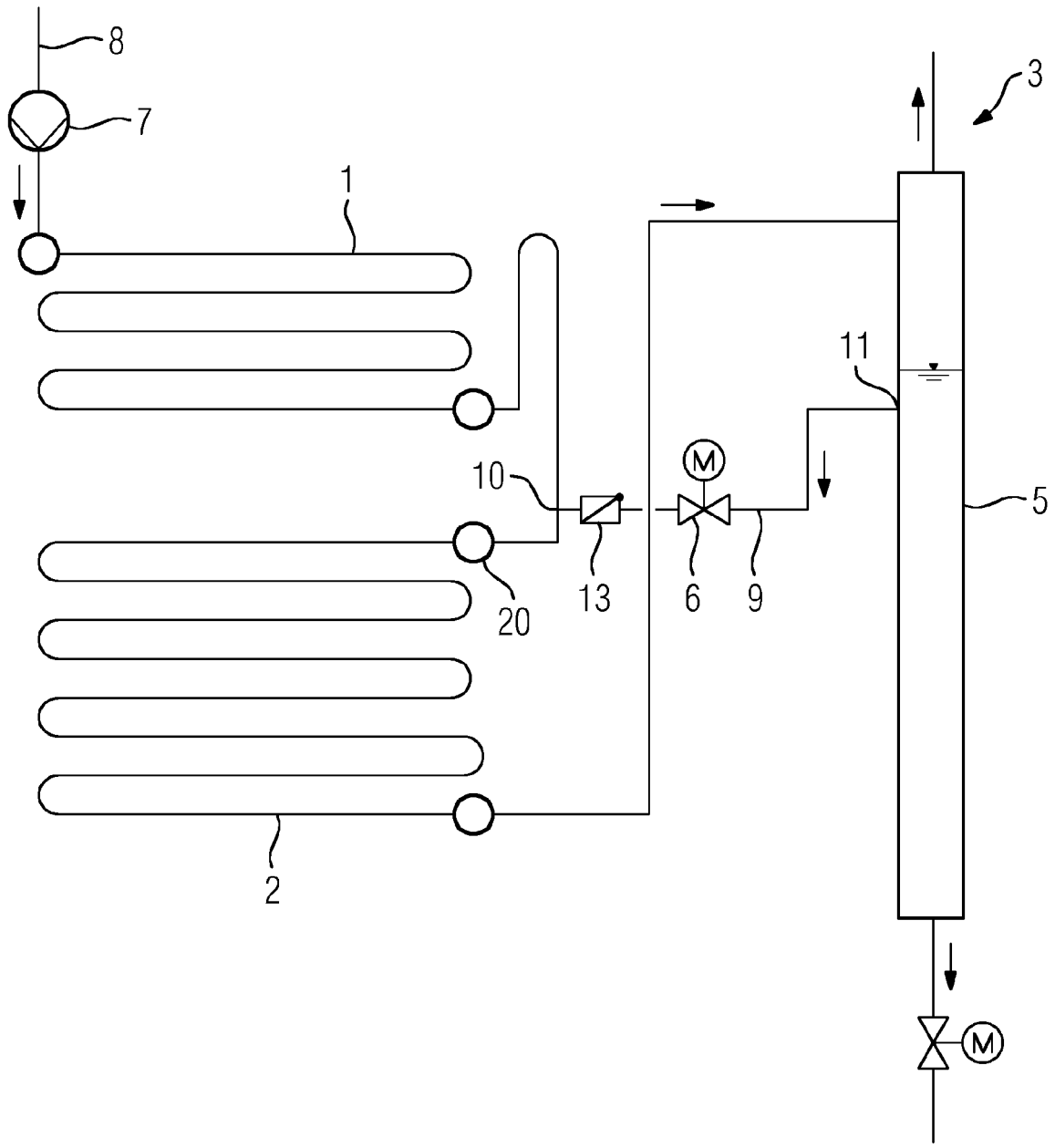
FIG. 2 shows a device for starting up a vertical forced-flow steam generator, with a water separation system in which a separator and a bottle form a unit.

FIG. 2 shows a less advantageous solution of the problem. For the implementation of this solution, it is however possible for the separator 4 and the water bottle 5 of the water separation system 3 to remain in a common vessel. The return flow of the non-evaporated separated working fluid into the evaporator 2 is again realized via the return line 9 and the shut-off fitting 6 situated therein or the check valve 13. As soon as, during startup, the water expelled from the evaporator 2 arrives in the separator 4 and is separated out, firstly the water level in the water bottle 5 rises up to the level of the connection of the return line 9. Then, water can flow back into the evaporator 2. If the water expulsion has ended (pressure rise in the system), the shut-off fitting 6 in the return line 9 to the inlet collector 20 of the evaporator 2 is closed. The efficiency of this solution (described in FIG. 2) is lower than that of the embodiment in FIG. 1 since a return flow into the evaporator 2 is possible only when the water bottle 5 is substantially filled.

The embodiment in FIG. 3 again has, like the following embodiments, a water separation system 3 in which the separator 4 and the bottle 5 are separated, and differs from the embodiment in FIG. 1 by the design of the drain line 12. Here, the overflow to the bottle 5 is realized not via the outer wall of the separator 4 but via a pipe 15 inserted through the bottom 14 of the separator 4. The length of said pipe 15 determines here the fill level in the separator 4 that is established.

Figure 3:
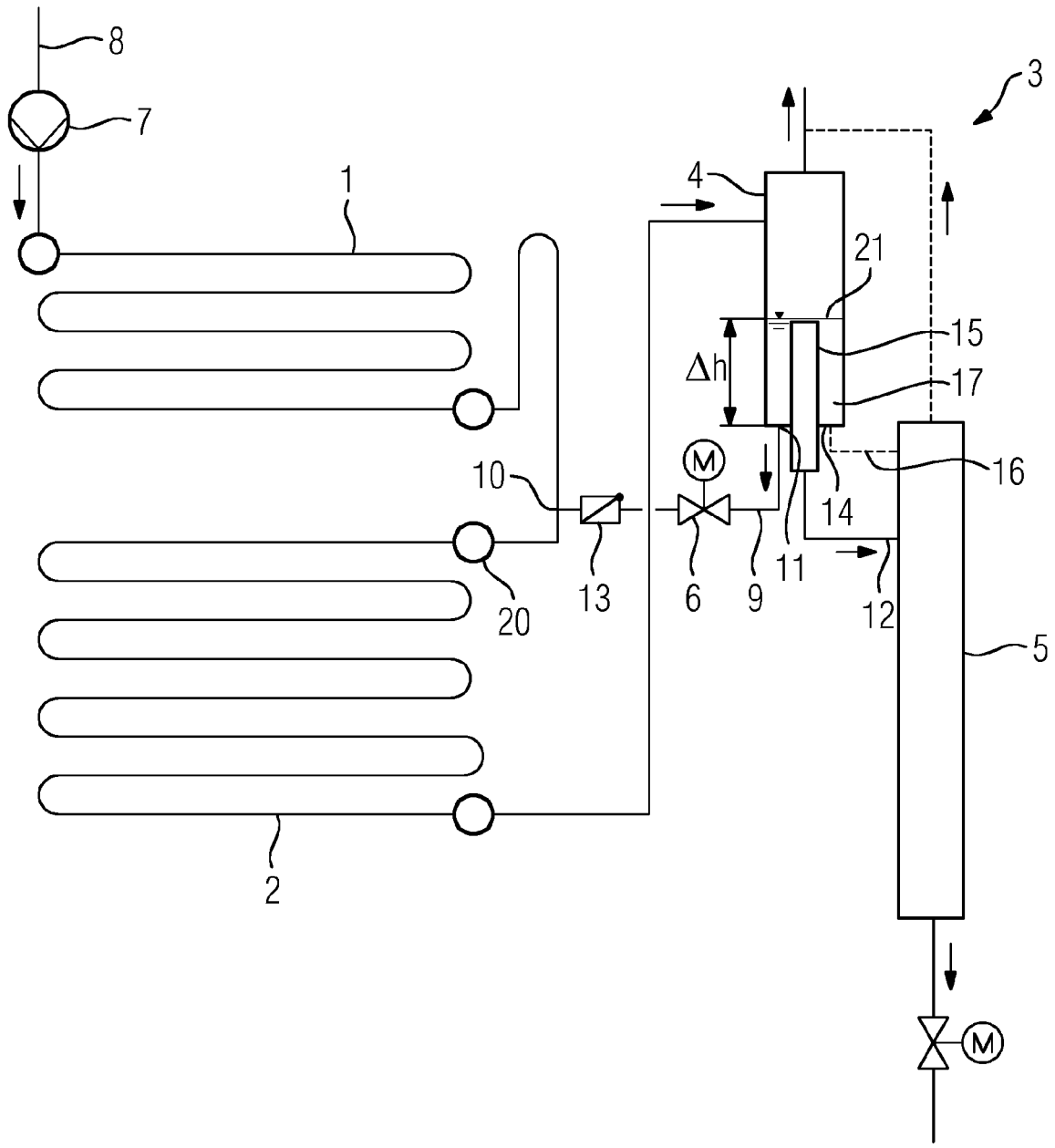
FIG. 3 shows a device for starting up a vertical forced-flow steam generator according to the invention, wherein the drain line for the overflow to the bottle comprises a pipe inserted through the bottom of the separator.
Figure 4:
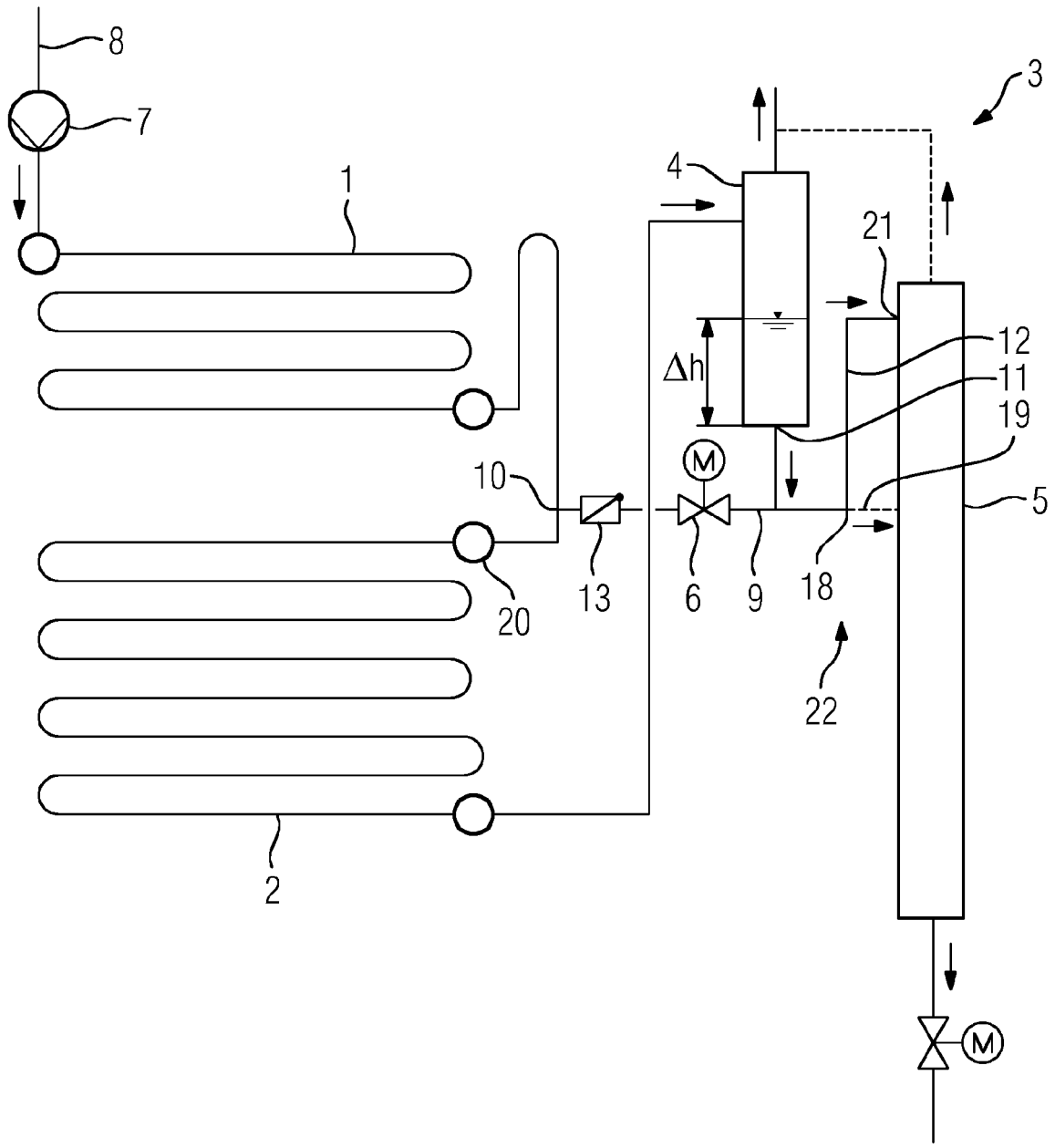
FIG. 4 shows a device for starting up a vertical forced-flow steam generator according to the invention, wherein the drain line comprises a siphon arranged between a separator and a bottle.

The embodiment in FIG. 4 differs from FIGS. 1 and 3 by the design of the drain line 12. Here, the overflow to the bottle 5 is realized not via the outer wall of the separator 4 or via a pipe 15 but via a siphon 22 arranged between the separator 4 and the bottle 5. The height of said siphon 22 determines here the fill level in the separator 4 that is established. For this purpose, one part of the drain line 12 between the separator 4 and the bottle 5 is formed in a siphon-like manner and, at its lowest point 18, is provided with a second evacuation line 19, which opens into the bottle 5.

Figure 5:
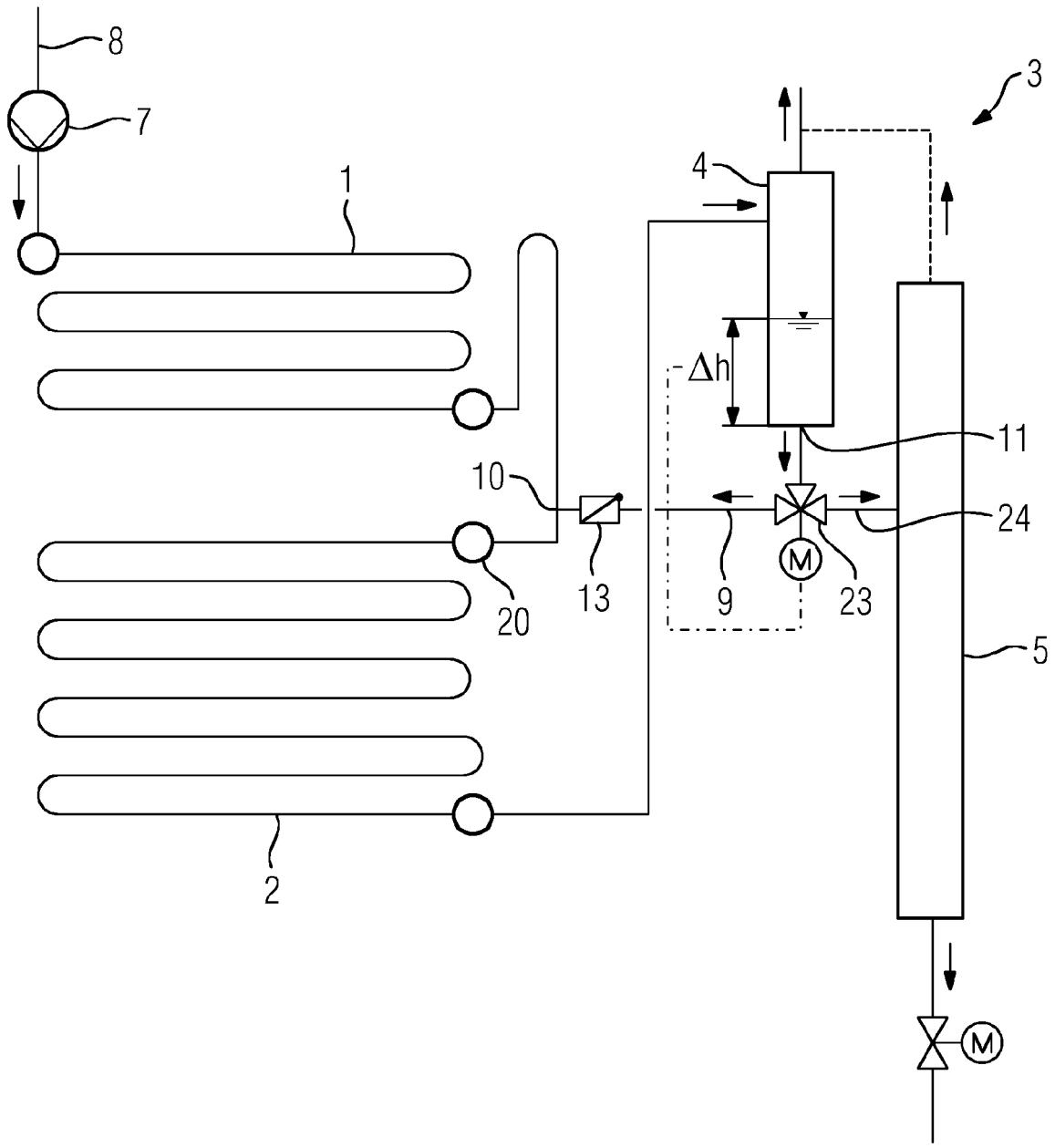
FIG. 5 shows a device for starting up a vertical forced-flow steam generator, in which recirculation and drainage to the bottle are realized via a three-way valve.

FIG. 5 shows a device for starting up a vertical forced-flow steam generator, with a return line 9, or drain line 12, which differs from the previous figures. Arranged in the return line 9 is a valve arrangement 23 with the function of a three-way valve, from which one line 24 branches off into the bottle 5, with the result that both recirculation and drainage to the bottle 5 are realized here via a three-way regulating valve 23. The setting of this three-way regulating valve 23 is regulated via the fill level in the separator 4.

The invention claimed is:

1. A method for starting up a vertical forced-flow steam generator in a waste-heat steam generator, comprising:

supplying feed water as a working fluid to the forced-flow steam generator, wherein the working fluid flows firstly through a feed water preheater and then through an evaporator and in the process the working fluid at least partially evaporates, supplying the partially evaporated working fluid to a water separation system in which non-evaporated working fluid is separated from evaporated working fluid and is collected, wherein the water separation system comprises a separator and a bottle, which are separate containers, wherein a return line from the separator opens into a point of connection of the evaporator and a working-medium outlet for the return line in the separator is situated above the point of connection that there is a geodetic return flow of the non-evaporated working fluid into the evaporator via the return line, wherein a drain line branches off from the separator and opens into the bottle and is arranged in the water separation system such that it is arranged above the return line, wherein at least a portion of the non-evaporated working fluid collected in the water separation system is supplied geodetically to the evaporator, wherein one part of the drain line between the separator and the bottle is formed in a siphon-like manner which opens into the bottle, and, in a second part of the drain line, the drain line further comprising a second evacuation line at the drain line's lowest point directly feeding into the bottle without siphon action, wherein the second evacuation line serves to exclusively evacuate the separator, and wherein, beyond a specific quantity of accumulating non-evaporated working fluid, a remaining portion is automatically discharged from the water separation system.

2. The method as claimed in claim 1, wherein, for returning the non-evaporated working fluid to the evaporator from the water separation system, a shut-off fitting is opened, and the quantity of returned working fluid is regulated solely by the geometry of the water separation system.

3. A device for starting up a vertical forced-flow steam generator in a waste-heat steam generator, comprising:

a feed water preheater which, by means of a feed water pump, is supplied with feed water as a working fluid via a feed water supply line, an evaporator which is arranged downstream of the feed water preheater in the direction of flow of the working fluid and which is flowed through by the working fluid and at least partially evaporates said working fluid, a water separation system at the outlet of the evaporator, which is adapted to separate non-evaporated working fluid from evaporated working fluid, wherein the water separation system comprises a separator and a bottle, which are designed as separate containers, wherein a return line from the separator opens into a point of connection of the evaporator and a working-medium outlet for the return line in the separator is situated so far above the point of connection that there is a geodetic return flow of the non-evaporated working fluid into the evaporator via the return line, wherein a drain line branches off from the separator and opens into the bottle and is arranged in the water separation system such that it is arranged, at least in part, above the return line, wherein one part of the drain line between the separator and the bottle is formed in a siphon-like manner which opens into the bottle, and, in a second part of the drain line, the drain line further comprising a second evacuation line at the drain line's lowest point directly feeding into the bottle without siphon action, wherein the second evacuation line serves to exclusively evacuate the separator.

4. The device as claimed in claim 3, wherein a shut-off fitting is arranged in the return line.

5. The device as claimed in claim 3, wherein a check valve is arranged in the return line.

* * * * *